US008656652B1

(12) United States Patent
Carrillo

(10) Patent No.: US 8,656,652 B1
(45) Date of Patent: Feb. 25, 2014

(54) SAFETY ANCHOR POST SYSTEM

(76) Inventor: Jose M. Carrillo, Elk Grove, CA (US)

( * ) Notice: Subject to any disclaimer, the term of this patent is extended or adjusted under 35 U.S.C. 154(b) by 51 days.

(21) Appl. No.: 13/411,785

(22) Filed: Mar. 5, 2012

(51) Int. Cl.
*E04H 12/34* (2006.01)
*E01F 13/02* (2006.01)

(52) U.S. Cl.
CPC ..... *E01F 13/026* (2013.01)
USPC ..... 52/165; 52/155; 52/169.13; 256/68

(58) Field of Classification Search
USPC ..... 52/699, 155, 156, 165, 169.13, 170, 52/831, 848, 295–297; 182/36, 112, 113; 256/65.01, 65.02, 65.03, 59, 65.04, 256/65.05, 65.06, 68–69, 65.14, DIG. 5; 248/156, 121
See application file for complete search history.

(56) References Cited

U.S. PATENT DOCUMENTS

| | | | | |
|---|---|---|---|---|
| 930,607 | A * | 8/1909 | Morrill | 52/165 |
| 3,880,405 | A * | 4/1975 | Brueske | 256/59 |
| 5,655,755 | A * | 8/1997 | Brandt | 256/67 |
| 5,971,668 | A | 10/1999 | Miller | |
| 6,439,344 | B1 | 8/2002 | Cole | |
| 6,779,630 | B2 | 8/2004 | Choate | |
| 7,108,249 | B2 * | 9/2006 | Bechtel | 256/65.14 |
| 2001/0017150 | A1 * | 8/2001 | Doreste | 135/15.1 |
| 2002/0175262 | A1 * | 11/2002 | Brooks, III | 248/530 |
| 2003/0015696 | A1 * | 1/2003 | Watson | 256/65.14 |
| 2003/0132427 | A1 * | 7/2003 | Allenbaugh | 256/65.14 |
| 2005/0051683 | A1 * | 3/2005 | Young | 248/187.1 |
| 2007/0131824 | A1 * | 6/2007 | Harold et al. | 248/156 |
| 2009/0159865 | A1 * | 6/2009 | Carvalho et al. | 256/65.14 |

* cited by examiner

*Primary Examiner* — Brian Glessner
*Assistant Examiner* — Beth Stephan
(74) *Attorney, Agent, or Firm* — Emery L. Tracy; Ruth Eure

(57) ABSTRACT

A safety anchor post system mountable to a pre-set anchor embedded in concrete for protecting a user from falling while working in precarious areas is provided. The system comprises a tubular post having a first end and a second end with a coil rod extending from the tubular post. A first sleeve is mounted at the second end of the post. A second sleeve is mounted between the first sleeve and the first end of the post with at least one rail member receivable within each sleeve. A clamping mechanism tightens against the rail members to releasably maintain the at least one rail member within each sleeve. A tie off device is mounted to the post. Upon releasably securing the at least one rail member within each sleeve and tying off to the tie off device, a worker is inhibited from falling from the support structure.

18 Claims, 1 Drawing Sheet

SAFETY ANCHOR POST SYSTEM

BACKGROUND OF THE INVENTION

1. Field of the Invention

This invention relates generally to a safety anchor post system and, more particularly, the invention relates to a safety anchor post system providing durable hand rails when working in precarious areas.

2. Description of the Prior Art

It is widely known that in the building and construction industry in the United States, falls are the leading cause of worker fatalities. On average each year between 150 and 200 workers are killed, and a staggering number of more than 100,000 workers are injured as a result of falls occurring at such building and construction sites. OSHA, the federal government agency that oversees labor and industry standards, has come to recognize that accidents are generally complex events that commonly involve a variety of factors. As a consequence, the standard for fall protection deals with both the human and equipment-related components in designing and implementing standards for protecting workers from fall hazards.

For example, in order to insure the protection of workers it is recommended that both employers and employees implement the following steps or procedures: 1) where protection is required, select fall protection systems appropriate for that situation; 2) use proper construction and installation of safety systems; 3) supervise employees properly; 4) use safe work procedures; and 5) train workers in the proper selection, use, and maintenance of fall protection systems.

More importantly, OSHA has developed specific rules, procedures and systems designed to prevent workers from falling off, onto or through working levels, and to protect workers from being struck by falling objects. These performance-oriented requirements facilitate the ability of employers to provide the mandated protection. The systems and procedures cover most construction workers except those inspecting, investigating, or assessing workplace conditions prior to the actual start of work or after all work has been completed. Areas or activities where fall protection is needed include ramps, runways and other walkways, excavations, hoist areas, holes, formwork and reinforcing steel, leading edge work, unprotected sides and edges, overhand bricklaying and related work, roofing work, precast concrete erection, wall openings, residential construction and other walking/working surfaces.

Under the above rules, systems and procedures employers are able to select fall protection measures and equipment that are compatible with the type of work being performed and the particular work site. Thus, fall protection systems and equipment can be provided through the use of guardrail systems, safety net systems, personal fall arrest systems, positioning device systems, and warning line systems. While the aforementioned systems cover many situations, one critical problem is the current non-availability of any type of parapet-type safety and fall protection system that can be easily set up and attached to the wall surfaces of home or building structures that may be surrounded by uneven or un-level ground, especially uneven ground surrounding the eaves of the structure. It is often the case that a walkway is constructed on the site by carpenters using 2×4's and 2×6's that in many cases is the building material that should be used in the home construction, but is instead diverted to construct a hand-built, makeshift walkway prone to failure and accidents.

Despite the ingenuity of conventional systems and devices, there remains a need for a safe, reliable adjustable walkway so that the walkway is disposed in a level and safe manner for use by the workers.

SUMMARY

The present invention is a safety anchor post system for protecting a user from falling while working in precarious areas. The safety anchor post system is mountable to a pre-set anchor or support structure embedded in concrete. The safety anchor post system comprises tubular post having a first end and a second end with a coil rod extending from the tubular post. The first end of the tubular post is releasably receiving at least a portion of the coil rod. A first sleeve is mounted at the second end of the post and a second sleeve is mounted between the first sleeve and the first end of the post with at least one rail member receivable within each sleeve. A clamping mechanism is movable within each sleeve and tightenable against the rail members to releasably and securely maintain the at least one rail member within each sleeve. A tie off device is mounted between the second sleeve and the first end of the post. Upon releasably securing the at least one rail member within each sleeve and tying off to the tie off device, a worker is inhibited from falling from the support structure.

In addition, the present invention includes a safety anchor post system for protecting a user from falling while working in precarious areas. The safety anchor post system is mountable to a pre-set anchor support structure embedded in concrete. The safety anchor post system comprises a tubular post having a first end and a second end with a coil rod extending from the first end of the tubular post. A tightening arm is positioned nearingly adjacent the second end, the tightening arm having a first end and a second end. A first sleeve mounted at the second end of the post and a second sleeve mounted between the tightening arm and the first end of the post. At least one rail member is receivable within each sleeve. A clamping mechanism is movable within each sleeve and tightenable against the rail members to releasably and securely maintain the at least one rail member within each sleeve. A rotatable tie off device is mounted between the second sleeve and the first end of the post. Upon releasably securing the at least one rail member within each sleeve and tying off to the tie off device, a worker is inhibited from falling.

The present invention further includes a method for protecting a user from falling while working in precarious areas. The method comprises providing a tubular post having a first end and a second end, extending a coil rod from the first end of the tubular post, threading the coil rod at first end to the support structure, releasably positioning the first end of the tubular post over at least a portion of the coil rod, mounting a first sleeve at the second end of the post, mounting a second sleeve between the first sleeve and the first end of the post, positioning at least one rail member within each sleeve, moving a clamping mechanism within each sleeve, tightening the clamping mechanism against the rail members to releasably and securely maintain the at least one rail member within each sleeve, mounting a tie off device between the second sleeve and the first end of the post, and inhibiting a worker from falling from the support structure.

DETAILED DESCRIPTION OF THE PREFERRED EMBODIMENTS

Figure 1:
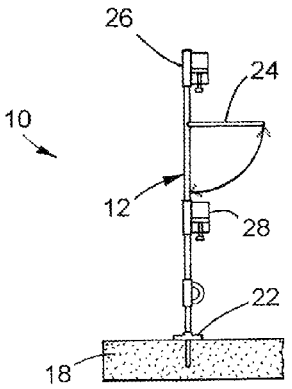
FIG. 1 is an elevational side view illustrating a safety anchor post system, constructed in accordance with the present invention.
Figure 2:
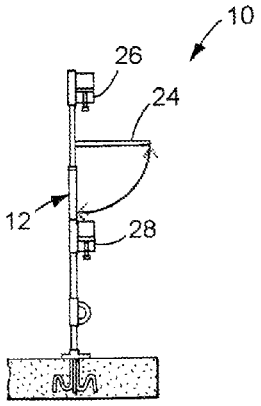
FIG. 2 is an elevational side view illustrating another embodiment of the safety anchor post system, constructed in accordance with the present invention, with a coil stem and coil stem chair.
Figure 4:
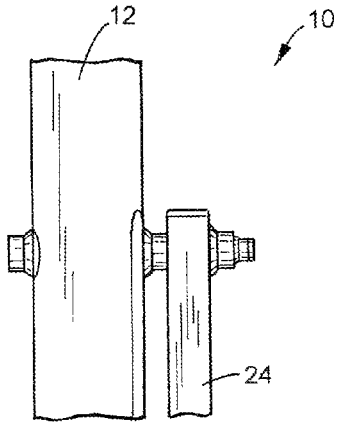
FIG. 4 is an elevational side view illustrating a tightening arm of the safety anchor post system, constructed in accordance with the present invention.
Figure 3:
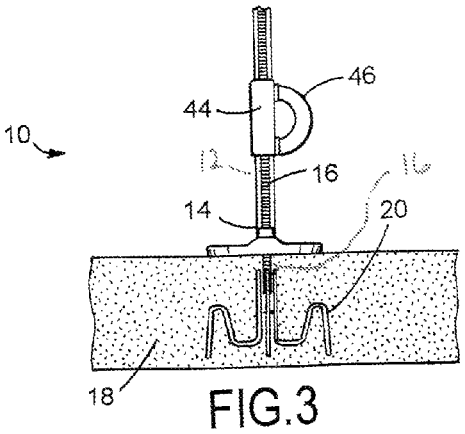
FIG. 3 is an elevational side view illustrating the bottom portion of the safety anchor post system with the swivel tie off point, constructed in accordance with the present invention.
Figure 5:
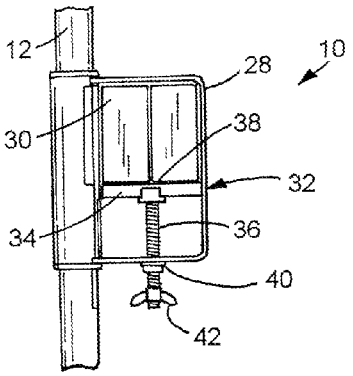
FIG. 5 is an elevational side view illustrating a rail securing system of the safety anchor post system, constructed in accordance with the present invention.

As illustrated in FIGS. 1-5, the present invention is a safety anchor post system, indicated generally at 10, providing durable hand rails when working in precarious areas. The safety anchor post system 10 of the present invention is an easily installed, safe-to-use support system complying will all safety guidelines set by the Occupational Safety and Health Administration (OSHA).

The safety anchor post system 10 of the present invention comprises an elongated, tubular post 12 having a first end and a second end and preferably measuring approximately forty-two inches (42") in total height from the first end to the second end. The first end of the post 12 has an opening with a coil rod protruding from the first end of the post 12. The coil rod 16 can be threaded directly into a pre-set anchor or support structure 18 in concrete, or can be inserted into a stem chair 20 pre-formed into the concrete. Furthermore, the post 12 can be tightened directly against the pre-set anchor or support structure 18 or can be tightened against a base plate 22 resting upon the pre-set anchor or support structure 18. The first end of the post 12 has an opening with a stem nut 14 welded therein with the stem nut 14 threadably receiving the coil rod 16 and movable relative to the coil rod 16 along the threads thereby limiting the extent of the coil rod 16 being threaded into the pre-set anchor or support structure 18 in the concrete.

In addition, the safety anchor post system 10 of the present invention includes a tightening arm 24 positioned adjacent the second end of the post 12 with the tightening arm 24 having a first end and a second end. The first end of the tightening arm 24 is pivotally secured to the post 12 while the second end of the tightening arm 24 is movable away from and toward the post 12. By moving the second end of the tightening arm 24 away from the post 12, the user gains a leverage advantage to drive the coil rod 16 of the post 12 into the pre-set anchor 18.

The safety anchor post system 10 of the present invention further includes a first sleeve 26 mounted at the second end of the post 12 and a second sleeve 28 mounted between the tightening arm 24 and the first end of the post 12. The first sleeve 26 and the second sleeve 28 are preferably identical with each receiving a pair of rail members 30. A clamping mechanism 32 is movable within each sleeve 26, 28 and tightenable against the rail members 30 to releasably and securely maintain the rail members 30 within each respective sleeve 26, 28.

In a preferred embodiment of the safety anchor post system 10 of the present invention, the clamping mechanism 32 includes a swivel anchor plate 34 mounted to a swivel post 36 by means of an adjustable swivel post head 38. A threadable anchor 40 mounted to each of the sleeves 26, 28 threadably receives the swivel post 36 allowing the swivel anchor plate 34 to move toward and away from the rail members 30. Once the desired position of the swivel anchor plate 34 has been reached, a butterfly nut 42 can be tightened against the threadable anchor 40 thereby maintaining the desired relative position of the swivel anchor plate 34 against the rail members 30 thereby releasably locking steadfastly into place without the need to employ any other tools for this purpose. It should be noted that the position of the first sleeve 26 and the second sleeve 28 can be fixed on the post 12 or adjustable to move along the length of the post 12, depending on the desires of the user and manufacturer.

Mounted between the second sleeve 28 and the first end of the post 12 of the safety anchor post system 10 of the present invention is rotatable anchor sleeve 44 with a tie off ear 46 mounted thereto. In use, a user can secure himself or herself to the tie off ear 46 thereby inhibiting the user from accidentally falling when he or she is working in an area that has a perimeter of limited tie off points. The rotatable anchor sleeve 44 allows the user to move freely without concern of tangling of the tie off line.

The safety anchor post system 10 of the present invention affords a number of important benefits and advantages. Created by a construction professional for express use by fellow tradesmen when working steep, high areas, such as high rise buildings and bridges, the safety anchor post system provides effortless safety when support and balance are essential. Easily embedded into concrete and able to withstand hundreds of pounds, the safety anchor post system 10 is the ideal accoutrement to line leading edges. Expediently installed without the need for additional tools, the safety anchor post system 10 saves valuable time on construction jobs where wasted minutes equal wasted dollars. Thus, employment of multiple units of the portable, lightweight safety anchor post system 10 exponentially increases production while remaining in compliance with OSHA safety guidelines. Because of this, companies that insure such projects will certainly look kindly on the use of the safety anchor post system 10 since it can be installed in a line of units that are eight feet apart or less, and pass on reduced premiums to construction companies. Fashioned of durable, high quality materials and components, a product such as the safety anchor post system 10 is sure to withstand multiple uses at many jobsites.

The safety anchor post system 10 of the present invention can conceivably revolutionize the construction industry. Promoting efficiency, productivity, and most importantly, safety, the safety anchor post system 10 can become the industry standard.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A safety anchor post system for protecting a user from falling while working in precarious areas, the safety anchor post system mounted to a pre-set anchor or support structure embedded in concrete, the safety anchor post system comprising:

a tubular post having a first end and a second end;

a first sleeve mounted at the second end of the post, the first sleeve having a first bracket;

a second sleeve mounted between the first sleeve and the first end of the post, the second sleeve having a second bracket;

at least one rail member receivable within each sleeve;

a clamping mechanism movable within each bracket and tightenable against the rail members to releasably and securely maintain the at least one rail member within each bracket; and a tie off device mounted between the second sleeve and the first end of the post;

wherein the clamping mechanism includes a swivel anchor plate mounted to a swivel post by means of an adjustable swivel post head, wherein a threadable anchor is mounted to each of the sleeves and threadably receives the swivel post allowing the swivel anchor plate to move toward and away from the rail members, wherein a butterfly nut is tightenable against the threadable anchor thereby maintaining the desired relate position of the swivel anchor plate against the rail members thereby releasably locking steadfastly into place.

2. The safety anchor post system of claim 1 and further comprising:

a coil rod extending from the first end of the tubular post;

wherein the first end of the post has an opening with a stem nut welded therein, the stem nut threadably receiving the coil rod and movable relative to the coil rod along the threads.

3. The safety anchor post system of claim 2 wherein the post is tightened directly against the support structure.

4. The safety anchor post system of claim 2 and further comprising:

a base plate restable upon the support structure;

wherein the post is tightened against the base plate.

5. The safety anchor post system of claim 2 wherein the coil rod is threaded directly into the pre-set anchor.

6. The safety anchor post system of claim 2 wherein the coil rod is threaded into a stem chair preformed into the pre-set anchor or support structure.

7. The safety anchor post system of claim 1 and further comprising:

a tightening arm positioned adjacent the second end, the tightening arm having a first end and a second end.

8. The safety anchor post system of claim 7 wherein the first end of the tightening arm is pivotally secured to the post, wherein the second end of the tightening arm is movable away from and toward the post.

9. The safety anchor post system of claim 1 wherein the tie off device includes a rotatable anchor sleeve with a tie off ear mounted thereto.

10. A method for protecting a user from falling while working in precarious areas, the method comprising:

providing a tubular post having a first end and a second end;

mounting a first sleeve at the second end of the post, the first sleeve having a first bracket;

mounting a second sleeve between the first sleeve and the first end of the post, the second sleeve having a second bracket;

positioning at least one rail member within each bracket;

moving a clamping mechanism within each bracket wherein the clamping mechanism includes a swivel anchor plate mounted to a swivel post by means of an adjustable swivel post head, wherein a threadable anchor is mounted to each of the sleeves and threadably receives the swivel post allowing the swivel anchor plate to move toward and away from the rail members, wherein a butterfly nut is tightenable against the threadable anchor thereby maintaining the desired relative position of the swivel anchor plate against the rail members thereby releasably locking steadfastly into place;

tightening the clamping mechanism against the rail members to releasably and securely maintain the at least one rail member within each sleeve; and mounting a tie off device between the second sleeve and the first end of the post.

11. A safety anchor post system for protecting a user from falling while working in precarious areas, the safety anchor post system mounted to a pre-set anchor support structure embedded in concrete, the safety anchor post system comprising:

a tubular post having a first end and a second end;

a tightening arm positioned adjacent the second end, the tightening arm having a first end and a second end;

a first sleeve mounted at the second end of the post, the first sleeve having a first bracket;

a second sleeve mounted between the tightening arm and the first end of the post, the second sleeve having a second bracket;

at least one rail member receivable within each sleeve;

a clamping mechanism movable within each bracket and tightenable against the rail members to releasably and securely maintain the at least one rail member within each bracket; and a rotatable tie off device mounted between the second sleeve and the first end of the post;

wherein the clamping mechanism includes a swivel anchor plate mounted to a swivel post by means of an adjustable swivel post head, wherein a threadable anchor is mounted to each of the sleeves and threadably receives the swivel post allowing the swivel anchor plate to move toward and away from the rail members, wherein a butterfly nut is tightenable against the threadable anchor thereby maintaining the desired relative position of the swivel anchor plate against the rail members thereby releasably locking steadfastly into place.

12. The safety anchor post system of claim 11 and further comprising:

a coil rod extending from the first end of the tubular post;

wherein the first end of the post has an opening with a stem nut welded therein, the stem nut threadably receiving the coil rod and movable relative to the coil rod along the threads.

13. The safety anchor post system of claim 12 wherein the post is tightened directly against the support structure.

14. The safety anchor post system of claim 12 and further comprising:

a base plate restable upon the support structure;

wherein the post is tightened against the base plate.

15. The safety anchor post system of claim 12 wherein the coil rod is embedded directly into a support structure.

16. The safety anchor post system of claim 12 wherein the coil rod is inserted into a stem chair preformed into the support structure.

17. The safety anchor post system of claim 11 wherein the first end of the tightening arm is pivotally secured to the post, wherein the second end of the tightening arm is movable away from and toward the post.

18. The safety anchor post system of claim 11 wherein the tie off device includes a rotatable anchor sleeve with a tie off ear mounted thereto.

* * * * *